United States Patent [19]

Houston

[11] Patent Number: 4,559,790

[45] Date of Patent: Dec. 24, 1985

[54] APPARATUS FOR MAINTAINING ELECTRONIC EQUIPMENT AND THE LIKE AT LOW TEMPERATURES IN HOT AMBIENT ENVIRONMENTS

[75] Inventor: John M. Houston, Schenectady, N.Y.

[73] Assignee: General Electric Company, Schenectady, N.Y.

[21] Appl. No.: 434,786

[22] Filed: Oct. 18, 1982

[51] Int. Cl.[4] ..... F25D 23/00

[52] U.S. Cl. ..... 62/259.3; 165/104.21

[58] Field of Search ..... 62/259.3, 480, 304, 62/260; 165/45, 104.21, 80 A

[56] References Cited

U.S. PATENT DOCUMENTS

| | | | |
|---|---|---|---|
| 3,038,074 | 6/1962 | Scheratskoy | 259/83 |
| 3,394,885 | 7/1968 | Arnot | 236/32 |
| 3,488,970 | 1/1970 | Hallenburg | 62/259.3 |
| 4,250,720 | 2/1981 | Sigel | 62/480 |
| 4,370,192 | 1/1983 | Cooley | 62/514 R |

*Primary Examiner*—Henry Bennett

*Attorney, Agent, or Firm*—Lawrence D. Cutter; James C. Davis, Jr.; Marvin Snyder

[57] ABSTRACT

Electronic equipment and the like, particularly electronic equipment used in oil well logging, is kept cool by placing it in a container inside a vacuum dewar filled with a vaporizable fluid such as water. As the water evaporates, it removes heat from the dewar. The water vapor is absorbed inside a canister filled with a water-absorbing material. A thermostatically-controlled valve is provided to limit water vaporization when not required for cooling, thus greatly extending the life of a single charge of cooling fluid.

14 Claims, 8 Drawing Figures

APPARATUS FOR MAINTAINING ELECTRONIC EQUIPMENT AND THE LIKE AT LOW TEMPERATURES IN HOT AMBIENT ENVIRONMENTS

BACKGROUND OF THE DISCLOSURE

The present invention relates to an apparatus for maintaining proper operating temperatures for electronic instrumentation and the like enclosed therein. In particular, it relates to an apparatus in which a vaporizable cooling medium is employed to carry heat away from the electronic equipment in the form of vapor which is absorbed in a canister filled with a vapor absorbent chemical, so as to form a totally self-contained equipment cooling system. The present invention is particularly applicable to the cooling of bore hole instrumentation used in oil well logging.

In modern oil exploration technology, bore holes extending as deep as 20,000 feet and deeper are becoming quite common. Additionally, ever-increasingly sophisticated instrumentation packages are lowered into the oil well bore hole to gather chemical, geological, nuclear, sonic and other forms of information in attempts to evaluate the prospects for oil, gas or other mineral recovery from the underlying rock strata. However, temperatures within the bore hole can be as high as 225° C. However, temperatures between about 150° C. and about 200° C. are more commonly encountered. Since modern electronic circuits begin to exhibit problems at temperatures between about 80° C. and 100° C., the use of electronic devices, such as conventional silicon integrated circuits and memory chips, is either totally excluded or is at least significantly impaired. The problem of cooling the bore hole instrumentation package is seen to be a significant one in light of the fact that the equipment one is seeking to cool may be about four miles away, underground. Accordingly, the desirability of some form of self-contained cooling system for this instrumentation package is highly desirable.

The problem of cooling instrumentation packages in oil well logging systems is appreciated in U.S. Pat. No. 3,038,074, issued June 5, 1982 to S. A. Scherbatskoy. However, there is no provision therein which limits the vaporization of the cooling fluid to those times for which it is most desirable, namely, when the temperature within the package exceeds about 50° C. In the Scherbatskoy apparatus vaporizing liquid continuously evaporates from the reservoir thus shortening the length of time that the package is operable under bore hole thermal conditions. Moreover, Scherbatskoy is unappreciative of the particular advantages of calcium oxide, sodium oxide or Zeolite as coolant absorbent materials.

SUMMARY OF THE INVENTION

In accordance with a preferred embodiment of the present invention, a dewar enclosing the electronic equipment to be cooled is disposed within an insulated housing and surrounded by a vaporizable cooling medium such as water. Also disposed within the housing is a quantity of coolant vapor absorbent material which reacts with the vaporized coolant to absorb it and to thereby reduce the vapor pressure of the coolant within the housing. In this way, heat is removed from the volume surrounding the electronic equipment through the action of coolant vaporization and reabsorption at another location within the apparatus housing. Furthermore, there is provided a thermostatically-controlled valve which substantially extends the usable duration of the charge of cooling fluid.

Accordingly, it is an object of the present invention to provide a self-contained, long-lasting, rechargable cooling system for electronic equipment packages and the like.

It is a particular object of the present invention to provide an apparatus for cooling electronic equipment packages for use in bore holes, such as are found in the oil exploration industry.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figure 1:
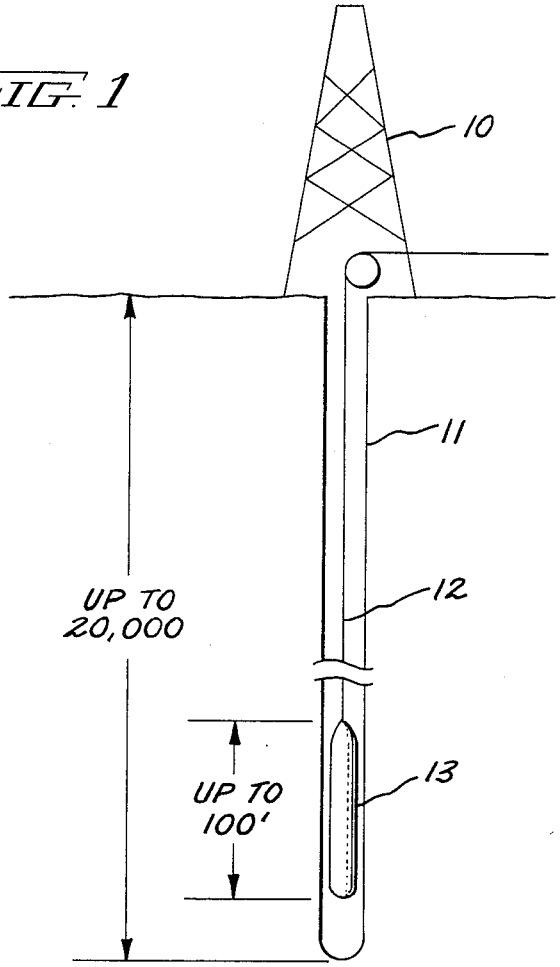
FIG. 1 is a schematic diagram illustrating one environment in which the instant application is particularly useful.

FIG. 1 is illustrative of at least one environment in which it is contemplated that the present invention is particularly useful. FIG. 1 shows oil rig 10 disposed over bore hole 11 which can extend downward from rig 10 to a depth of 20,000 feet or more. During the drilling of bore hole 11, instrumentation packages such as capsule 13 may be periodically lowered by wire line 12 to perform various instrumentation functions relating to chemical, geological and other structures present in the bore hole. However, the ambient temperatures within these bore holes, particularly the deeper ones, are generally in the range of between about 150° C. and 225° C. This temperature range is sufficiently high to be deleterious to most electronic instrument packages, particularly present-day instrumentation equipment using silicon integrated circuit chips. Accordingly, it is highly desirable to be able to provide means for cooling this package so that its temperature does not exceed approximately 100° C. Moreover, this cooling function must occur in an instrumentation capsule which may be more than 4 miles away in a hostile, subterranean environment.

Figure 2:
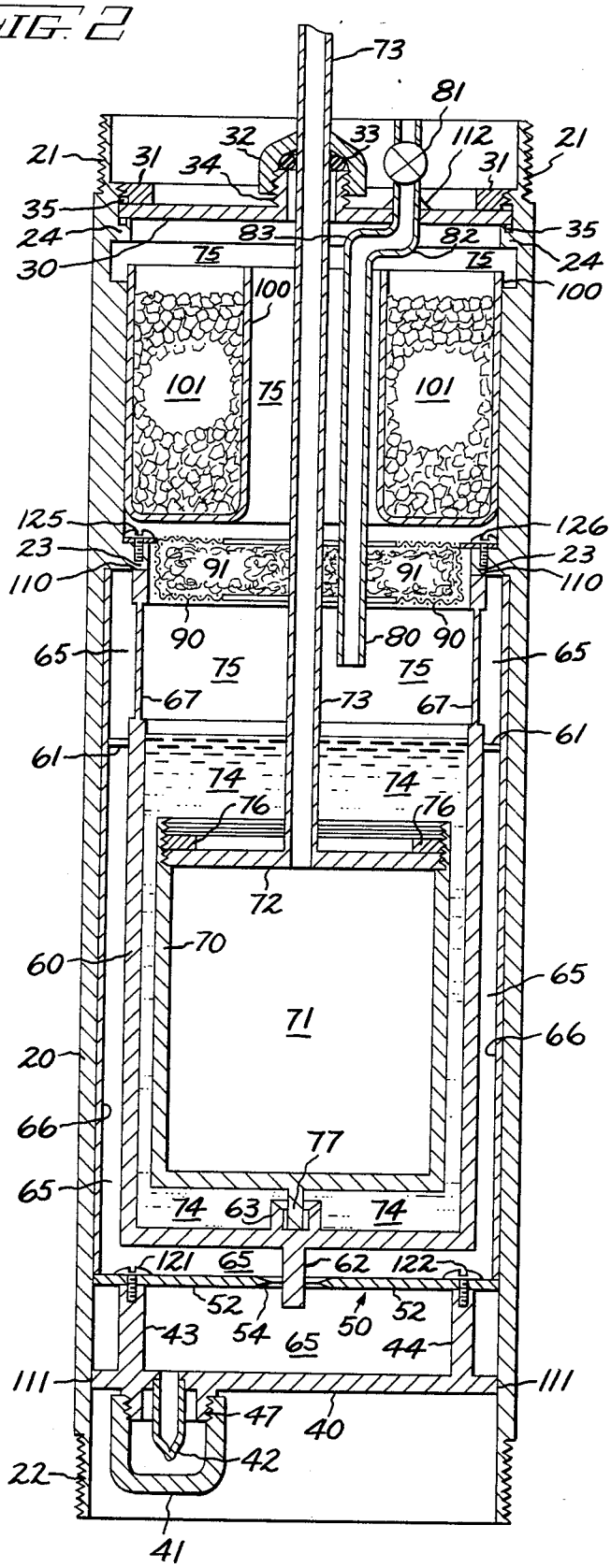
FIG. 2 is a cross-sectional side elevation view (not to scale) of an apparatus in accordance with one embodiment of the present invention.

FIG. 2 illustrates, in cross-sectional view, one embodiment of an invention which is capable of providing the desired instrumentation cooling. Moreover, the invention illustrated is self-contained and requires no external driving power nor external connection. Further advantages of the invention illustrated are described below.

The principal structures of the present invention comprise outer housing 20 in which inner dewar 60 is disposed but thermally isolated from outer housing 20. Within inner dewar 60, there is disposed a quantity of cooling medium 74, such as water, which surrounds inner housing 70 which together with inner housing lid 72, serves to define interior volume 71 in which electronic equipment and the like is disposed for thermal protection. In its active or charged condition, cooling medium 74 is disposed as a liquid at least partially surrounding inner housing 70. However, during operation of the present invention, cooling medium 74 is vaporized with the vapor therefrom thereby removing heat from inner housing 70. The vaporized cooling medium enters volume 75 which is in fluid communication with a quantity of cooling medium vapor absorbent material 101 disposed within canister 100. The vaporized cooling fluid thus acts as a thermal transfer medium for removing heat from the vicinity of volume 71 and transporting it to a safe location within canister 100 disposed at a distance from volume 71.

Having described the essential features of the embodiment of the present invention shown in FIG. 2, more particular attention is now given to the detail construction of each of these assemblies. In particular, it is seen that outer housing 20 comprises an elongate, preferably cylindrical structure having an upper threaded end 21 and a lower threaded end 22 for attachment within instrumentation capsule 13 which can have a total length of up to about 100 feet. It should also be noted that the invention illustrated in FIG. 1 is not drawn to scale. In particular, the long vertical dimension has been reduced for purposes of illustration. For example, volume 71 generally exhibits an inner diameter of approximately 2 inches but may, in fact, be between 1 and 2 feet in length. Housing 20 is preferably evacuable, so that volume 65 contains a partial vacuum. To this end, housing 20 is provided with bottom cap 40 sealably welded along joint 111 to housing 20. Bottom cap 40 possesses vacuum pinch-off connection 42 which is protected by threaded cap 41, attached to threaded nipple 47 extending from bottom cap 40. Bottom cap 40 also preferably possesses pedestals 43 and 44 for supporting centering disk structure 50, which is more particularly illustrated in FIG. 4, discussed below. At its upper end, outer housing 20 is sealed against atmospheric pressure by means of upper cap 30 held in place against lip 24 of housing 20 by threaded retaining ring 31. Additionally, O-rings 35 are provided on either side of upper cap 30 to maintain vacuum conditions within volume 75 of housing 20. Additionally, upper cap 30 possesses threaded nipple 34 onto which sealing nut 32 and O-ring 33 are disposed for providing a pressure-tight passage through upper cap 30 for conduit 73 which is typically used as a passage for electrical conductors from electrical and electronic equipment housed within volume 71. Evacuating tube 80 is also disposed through upper cap 30. Evacuating tube 80 may, for example, be sealably welded, as shown at joint 112 to upper cap 30 to provide the desired pressure-tight seal. Evacuating conduit 80 also preferably includes vacuum valve 81. It is through conduit 80 that the cooling medium is generally delivered during the initial charging of the apparatus of the present invention. Evacuating conduit 80 also preferably possesses right angle bends 82 and 83 as shown so that the conduit 80 may be properly disposed through an annular opening in canister 100.

Next is considered the detailed construction of inner dewar 60 which is typically in the form of a cylindrical container open at the top. Inner dewar 60 may be sealably welded along joint 110 to lip 23 of outer housing 20. It is thus seen that inner dewar 60 divides the interior of housing 20 into two volumes, namely, volume 65 and volume 75. Volume 65 is preferably maintained under vacuum conditions so as to provide thermal insulation between outer housing 20 and inner dewar 60. In this regard, it is to be specifically noted that several structures are specifically provided which tend to maximize the thermal insulation between outer housing 20 and inner dewar 60. In particular, it is seen that dewar 60 possesses centering pin 62 disposed through aperture 55 (see FIG. 4) in centering disk 50. This centering disk is designed to maintain minimal physical contact between inner dewar 60 and the centering disk 50. The detailed construction of centering disk 50 is more particularly described below in reference to the description of FIG. 4. Furthermore, inner dewar 60 is preferably provided with bumper pins 61 acting to center the dewar and simultaneously maintain minimal physical contact with outer housing 20. Furthermore, inner dewar 60 preferably possesses thin-walled portions 67 to reduce heat transfer from housing 20 to dewar 60 from along weld joint 110. Furthermore, outer housing 20 may be provided with inner sleeve 66 comprising aluminum or copper so as to provide a low emissivity surface to minimize radiative transfer of heat energy to inner dewar 60. Optionally, the interior surface of housing 20 may be polished to a high polish to provide the desired degree of low emissivity. However, because it may be difficult to polish the inside of steel pipe to the degree desired, a sleeve 66 of shiny copper or aluminum is preferably employed. Lastly, inner dewar 60 includes a centering well 63 having at least partially sloped sides to facilitate the insertion of centering pin 77 of inner housing 70.

The construction of inner housing and its associated structures is now discussed. In particular, it is seen in FIG. 2 that housing comprises cylinder 70 which, together with cap 72, defines volume 71 for housing the equipment for which protection is desired. Furthermore, it is seen in the Figure that cap 72 is held in place against cylinder 70 by means of threaded retaining ring 76. Additionally, it is seen that conduit 73 is attached to cap 72 so that electrical conductors from volume 71 may be passed therethrough so as to extend exteriorally from the sealed housing. However, it should be noted that in certain applications, the presence of conduit 73 may not be necessary. In particular, in certain applications in which the electronic equipment in volume 71 not only collects but stores data, it is contemplated that the entire inner housing may be removed following data collection in a hostile environment. Lastly, with respect to the inner housing, it is noted that in its charged, or ready condition, the inner housing is preferably totally surrounded by cooling medium 74, in its liquid phase.

As a result of exposure to high temperature environments, and in spite of the thermal insulation precautions taken, it is anticipated that a sufficient amount of heat energy is transferred to volume 71 to require the protection afforded by cooling medium 74 which evaporates as a result of the temperature conditions and expands into volume 75 wherein it is ultimately adsorbed by coolant absorbent 101 disposed in annular canister 100. Additionally, thermal insulating material 91 may be disposed if desired between the cooling reservoir and the absorbent canisters. In particular, FIG. 2 illustrates the use of glass fiber insulation 91 loosely disposed within screen housing 90 which preferably comprises a material such as stainless steel. Screen housing 90 is fastened to lip 23 of housing 20 by screws 125 and 126. Additionally, thermal insulation may be provided by a stack of metal foils instead of glass fiber insulation 90. However, if such foils are used, they must have apertures to permit sufficient flow of coolant vapor to the canisters containing the absorbent. The canisters are preferably disposed within housing 20 so as to be in close thermal contact therewith so that any heat of absorption generated is safely removed through the outer housing wall. However, this heat generation is not a significant problem because of the long length of the canister and the slow rate at which the coolant generally reacts with the absorber material.

Water is a particularly good choice as a coolant material. Moreover, if water is used, several absorbent materials are particularly suitable for use in canister 100. For example, calcium oxide, CaO, sodium oxide, $Na_2O$, or phosphorous oxide, $P_2O_5$, or mixtures thereof, may be employed. Calcium oxide (basically unslaked lime) is the preferred material for use with an aqueous coolant medium because it is inexpensive and does not form a corrosive solution after absorption of water vapor. The use of calcium oxide requires approximately 3.1 grams of calcium oxide for each gram of water absorbed. In accordance with one set of design dimensions for the present invention, the basic design requirements indicate the utilization of approximately 3.2 kilograms of calcium oxide to absorb 1.040 grams of water. However, since a safety factor is desired, a quantity of 10 kilograms of calcium oxide is preferable. Such a quantity of calcium oxide requires a canister about 220 cm long, assuming a calcium oxide pellet density of approximately 1.7 grams per cm (that is, half of the bulk calcium oxide density). This design further indicates that the canister inside diameter is approximately 2½" to fit into the conventional 3.63" diameter of the instrumentation capsule. Thus, a large length of absorber is needed and is preferably present in the form of a stack of several short canisters rather than as a single canister unit which is 7 feet long. While the immediately preceding quantitative description of the present invention is provided as a guiding example for the use of the present invention in bore hole instrumentation packages, the present invention should not be construed as being so limited either to the bore hole application or to the above-described quantitative description.

Because of the requirements for thermal insulation, it is generally desired to employ a low thermal conductivity material for certain of the structures in the present invention. In particular, stainless steel is the material of preference for constructing inner dewar 60, inner housing 70, cap 72, and for conduits 73 and 80. However, conventional steel compositions may be employed in housing 20, lower cap 40, upper cap 30 and in canisters 100. Lastly, centering disk structure 50 also preferably comprises stainless steel.

Figure 3:
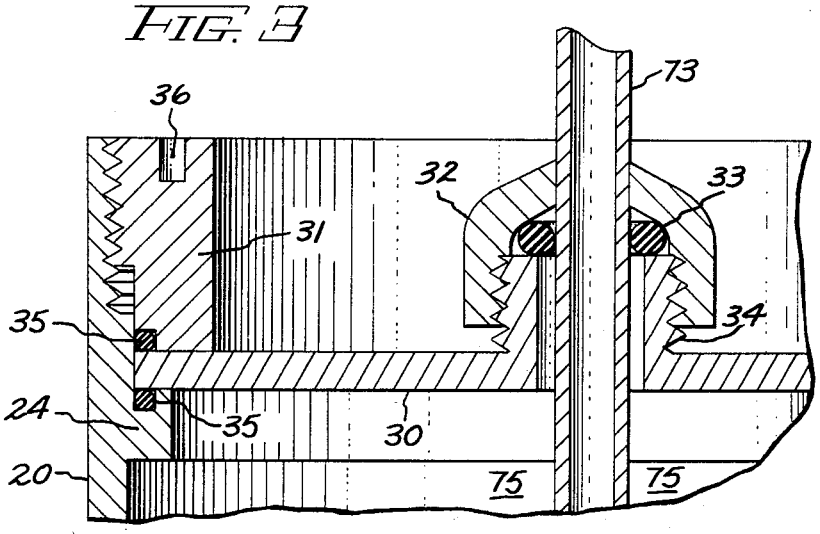
FIG. 3 is a cross-sectional side elevation view illustrating the detailed construction for an end cap to the housing assembly shown in FIG. 2.

FIG. 3 is a detailed cross-sectional side elevation view of upper cap 30 illustrated in FIG. 2. In particular, the placement of O-ring seals 35 on each side of end cap 30 is particularly shown. Additionally, threaded retaining ring 31, which holds end cap 30 in place against lip 24, is shown to possess aperture 36 which may be provided for insertion of a tool or device for rotating retaining ring 31 so as to provide a pressure-tight seal for volume 75 (see also FIG. 2 for the location of volume 75).

Figure 4:
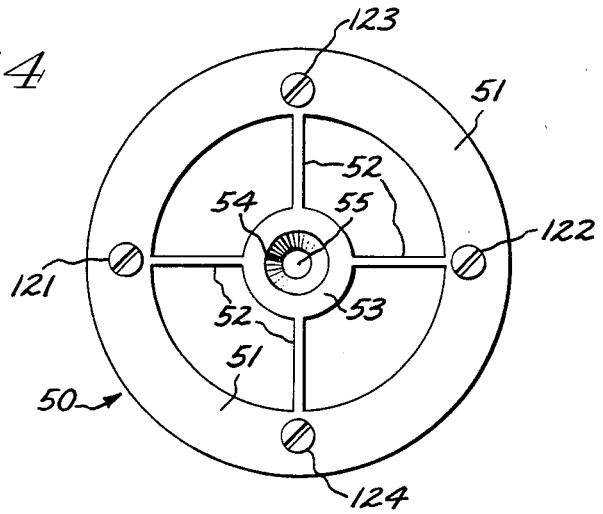
FIG. 4 is a plan view illustrating the construction of a disk for centering and thermally isolating the dewar.

FIG. 4 is a detail plan view more particularly illustrating centering disk 50 which is shown in cross section in FIG. 2. As mentioned above, centering disk 50 preferably comprises a low thermal conductivity material, such as stainless steel. It is fixed within housing 20 by any convenient means, such as, for example, by screws 121 and 122 which affix it to pedestals 43 and 44, respectively. Screws 123 and 124 also hold centering disk 50 in place against pedestals which are not visible in FIG. 2. Centering disk 50 preferably comprises outer ring 51 and inner ring 53 separated by two or more spokes 52 which act as low thermal conductivity heat transfer resistance means acting to support inner ring 53. Additionally, the radially-inner edge of inner ring 53 preferably possesses a beveled edge 54, more easily seen in FIG. 2 and correspondingly labeled therein. Central or inner ring 53 also possesses aperture 55 through which centering pin 62 of dewar 60 (in FIG. 2) is disposed. Such a structure assures minimal thermal contact between inner dewar 60 and outer housing 20.

Figure 5:
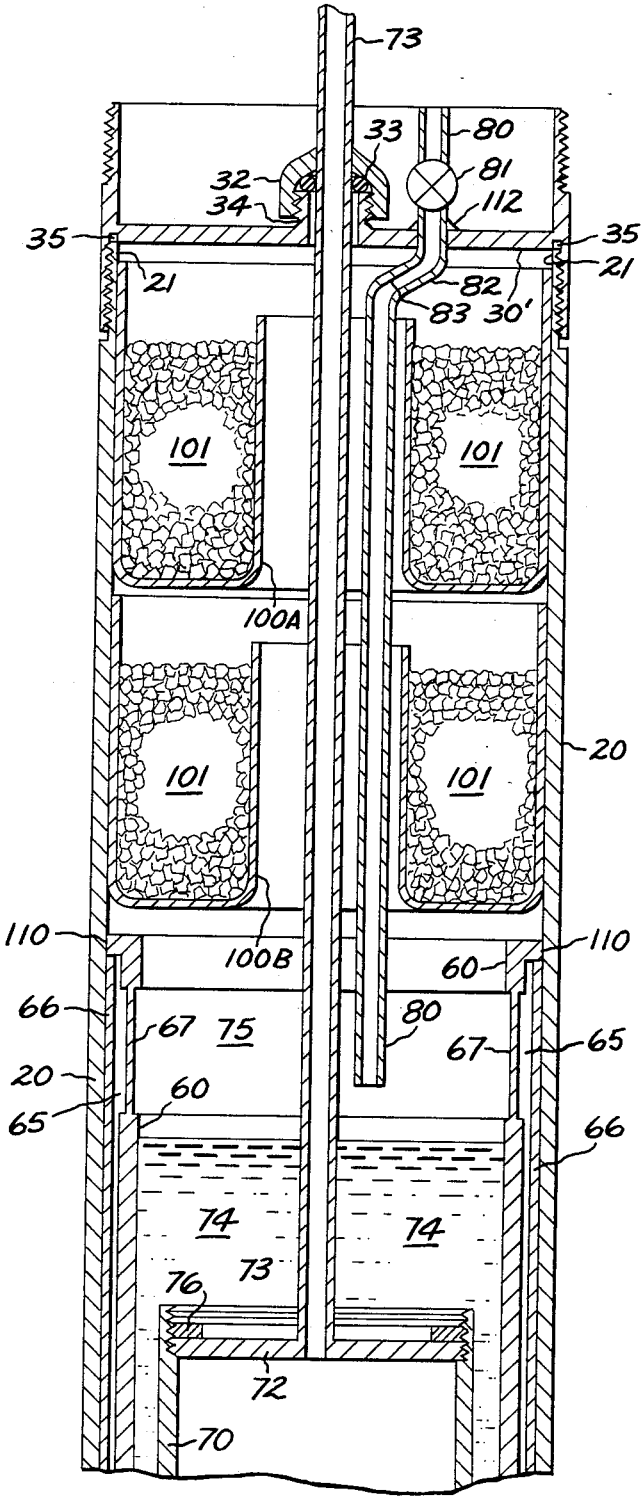
FIG. 5 is a cross-sectional side elevation view of an apparatus in accordance with the present invention illustrating a variation in end cap construction together with the presence of multiple canisters of absorbent material.

FIG. 5 is a view of an embodiment of the present invention similar to that shown in FIG. 2 except for two aspects. In particular, multiple canisters **100*a* and 100*b* are shown containing coolant absorbent material 101. Additionally, an alternate structure 30' is shown for the upper end cap. In this latter embodiment for the end cap structure, it is seen that it is directly screwed on to housing threads 21. In this embodiment, it is seen that bends 82 and 83 in evacuation conduit 80 are somewhat more critically oriented than in FIG. 2, since in the embodiment shown in FIG. 5, the rotating motion of upper cap 30' also causes rotation of conduit 80 about conduit 73. However, in the construction illustrated, bends 82 and 83 in conduit 80 eliminate any problems associated with rotation of cap 30'. One of the advantages of the end cap construction shown in FIG. 5 is the construction of thinner housing walls 20** in the vicinity of the housing in which the canisters of absorbent material are disposed. This arrangement enhances heat transfer from the canisters.

Figure 6:
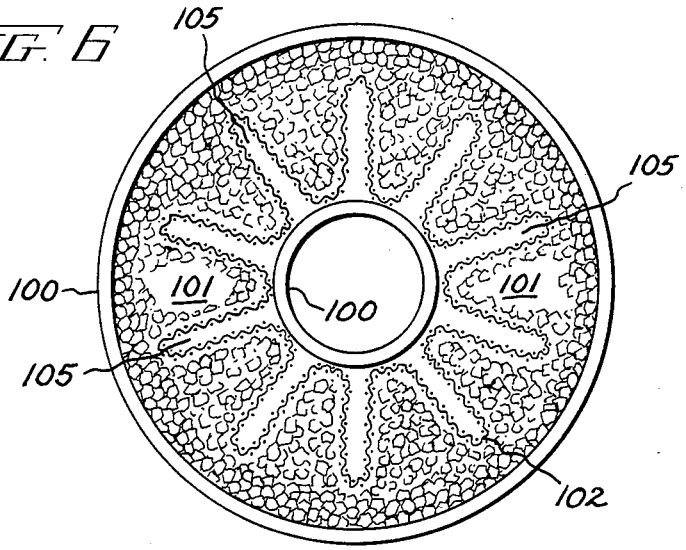
FIG. 6 is a plan view illustrating a preferred embodiment for the disposition of pellets of coolant vapor absorbent material.

FIG. 6 illustrates an arrangement of coolant absorber pellets within canister 100. In particular, it is seen that it is possible to dispose corrugated screen 102, such as a stainless steel screen, within canister 100, as shown, so as to provide open channels 105 through absorbent 101 so as to facilitate a more rapid absorption of the coolant by the pellets.

Figure 7:
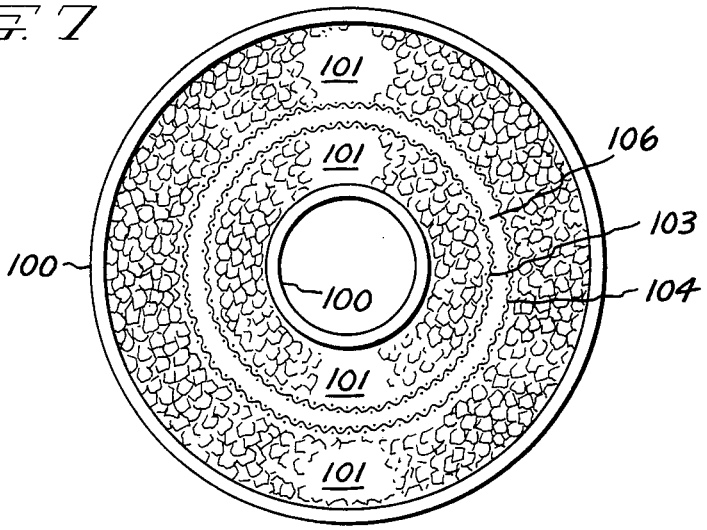
FIG. 7 is a plan view similar to FIG. 6 illustrating an alternate method for placement of absorbent material within a canister.

FIG. 7 illustrates another canister structure for enhancing the absorption of the vapor phase of the coolant medium. In particular, in this embodiment a pair of circular cylindrical screens 103 and 104 are concentrically disposed within cylindrical canister 100, as shown, as as to provide open channel 106. Again, this facilitates the absorption by the pellets of the vapor phase of the coolant.

Figure 8:
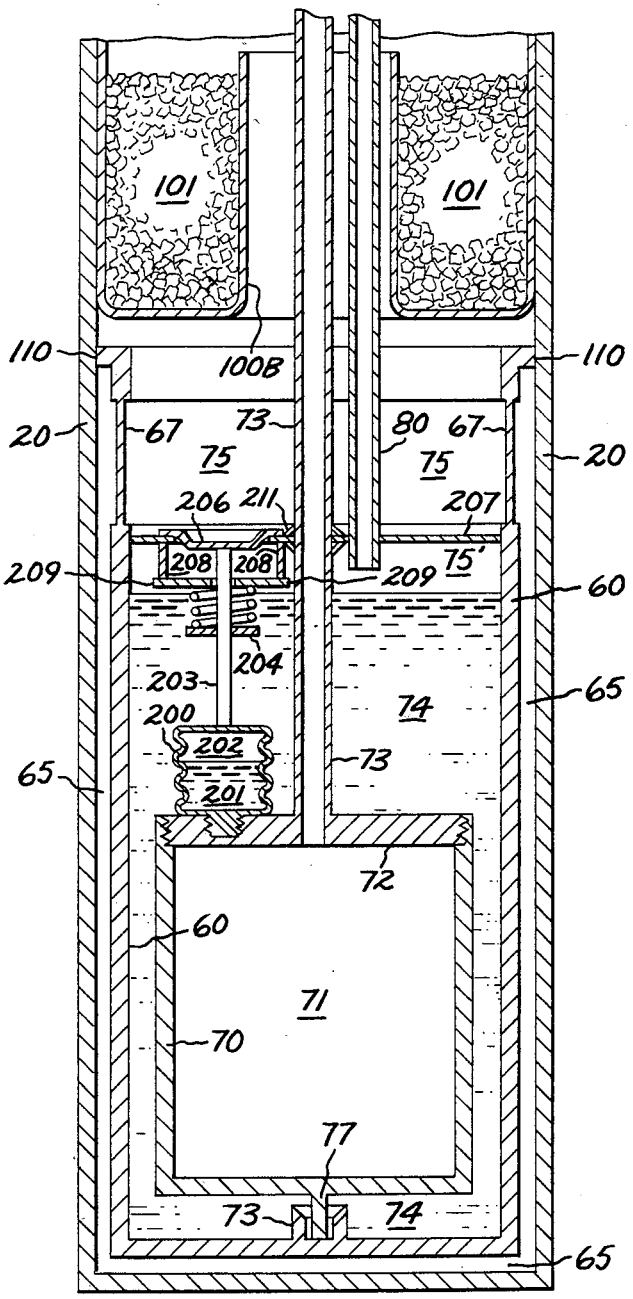
FIG. 8 is a cross-sectional side elevation view illustrating the incorporation of a thermostatically-controlled valve to prolong the usable duration of a single charge of liquid phase cooling medium.

FIG. 8 more particularly illustrates the present invention with a thermostatically-controlled valve disposed therein to prevent premature vaporization of the cooling medium 74 surrounding inner chamber 70. In particular, collapsable bellows 200, mounted in thermal contact with end cap 72 of inner housing 70 contains a suitable vaporizable medium 201, which is capable of expanding in the vapor phase into volume 202 so as to expand bellows 200. The materials and stiffness of the bellows, together with the stiffness of spring 205, is selected to be such that the valve is open at a temperature of approximately 50° C. Bellows 200 is attached to shaft 203 which operates to remove valve disk 206 from its corresponding valve seat on separating disk 207 which is mounted, for example, along weld joint 211 to conduit 73, as shown. Separating disk 207 provides a means for preventing vaporized coolant from volume 75' from entering volume 75, which is occupied by the absorbent material. In this way, premature vaporization of cooling medium 74 is prevented. Fluid communication between volumes 75 and 75' only occurs during increased temperature conditions in the vicinity of bellows 200. It should be noted that it is not essential that a perfect seal be maintained between valve disk 206 and separating disk 207 nor between separating disk 207 and the walls of dewar 60. The perfect seal is not required since it is only desired that as the valve opens, a transition from a small thermal conductance to a large thermal conductance is effected. Two rods 208 mounted on disk 207 and a guide 209 mounted on rods 208 act as a stop for spring 205 which is disposed in a compressive fit between guide 209 and arm or disk 204 on shaft 203. Spring 205 is compressed when the valve opens which occurs which shaft 203 provides a force in an upward direction in response to temperature conditions within the bellows 200. As the valve is opened, this permits vaporized cooling medium to reach the chemical absorber thus cooling the water. As the thermal load varies due to change in ambient bore hole conditions or to changes in the power being utilized within the chamber 71, the valve opens at appropriate thermal conditions so as to maintain the cooling medium at a temperature of approximately 50° C.

The advantages of incorporating such a thermostatically-controlled valve are several. In particular, the water temperature is maintained at a roughly 50° C. constant range in spite of wide variations in external temperature conditions or internal thermal load. The thermostatically-controlled valve of the present invention also prolongs the life of a given charge of liquid cooling medium and absorber since cooling medium vapor no longer enters the absorber during periods without a thermal load. Additionally, the valve prevents the possibility of freezing of water vapor during periods of low thermal load. Lastly, the valve illustrated comprises a simple, proven design requiring no separate operating power.

Vacuum valve 81 is provided in evacuation conduit 80 through upper cap 30 or 30' for the purpose of partially evacuating volume 75 of the apparatus. This evacuation facilitates transport of the coolant vapor to the absorber material. In this respect, the present invention is somewhat similar to a heat pipe. However, in the present invention, this evacuation, while desirable, is not necessary under all circumstances. Additionally, by extending evacuation tube 80 to a position below the absorber one can ship and store the present apparatus withou the liquid coolant therein. Although not shown in the Figures, it is preferable that vacuum valve 81 also be covered by a protective cap such as is provided by cap 41 which protects vacuum pinch-off 42. Thus, with evacuation tube 80 disposed as shown below the level of the absorber material, a measured amount of liquid coolant such as water may be added to the system through valve 81 to activate or charge the system. However, it is generally desirable that under such circumstances air not be permitted to enter volume 75. The presence of air is not desirable for the reason that the increased partial pressure due to air tends to inhibit the desirable vaporization of liquid coolant 74.

Since the apparatus of the present invention is capable of maintaining a low partial pressure of water vapor in volume 75, freezing of the liquid coolant, particularly if it is water, may be required to be guarded against. Methods of preventing this freezing not only include only partially evacuating volume 75, so as to limit the rate at which water vapor can flow to the absorber but also by adding an antifreeze material, such as ethylene glycol to the water.

A reversible mode of operation is also possible with the present invention. For example, if a water vapor absorber such as Zeolite is employed, it is possible to absorb large amounts of water vapor even at a temperature of 225° C. However, such materials reversibly yield this water vapor at higher temperatures of approximately 500° C. Accordingly, in such circumstances it is possible to construct a sealed, reversible cooling system. In this embodiment, the cooling system is reconditioned by baking the absorber so as to distill the water back into the water reservoir surrounding dewar 60. This may be provided perhaps by electrical heating coils disposed in the absorber material itself. Additionally, it is possible to surround a select exterior portion of the housing with heating coils to perform this distillation function. In an embodiment of the present invention in which conduit 73 is not present, it may also be desirable to simultaneously cool that portion of housing 20 surrounding volume 71 to ensure proper transfer of the water or other coolant from canisters 100 to the liquid reservoir. However, in embodiments of the present invention in which conduit 73 is present, it is possible to insert a water-cooled "finger" or other cooled, cold or cooling substance into volume 71 as an additional means to ensure proper condensation of coolant vapor in the reservoir volume.

Since the cooling system of the present invention is self-contained and since it operates through the vaporization of a finite quantity of coolant material, it is realized that the operation of the present invention is time-limited. Nonetheless, as described above, it is also seen that the present invention may be recharged and returned to its fully operational status in one of several ways. However, it should be appreciated by those utilizing the instant invention that it is desirable to minimize the generation of thermal energy within volume 71 by the electrical equipment being protected. Since many modern electronic devices involve the use of microprocessors which consume only small amounts of power, certain electrical equipment will therefore exhibit greater operational lifetimes. If higher wattage electronic devices are employed, it is nonetheless easy to incorporate a timing device in the electronic circuits which turns on the high wattage components for the few hours when the equipment is being utilized at the bottom of the bore hole or other environment. The lower wattage electronic equipment, such as memories and microprocessors, can generally be left on continuously in such cases.

From the above, it should be appreciated that the various embodiments of the present invention provide a convenient, rechargable, self-contained cooling system for electrical equipment and the like. Moreover, it is seen that the instant invention is particularly suitable for use in the protection of various forms of electronic instrumentation which are lowered into bore holes used in mineral and gas exploration. Furthermore, it is seen that, while the instant invention is particularly applicable to such oil and gas exploration purposes, it is generally applicable to the protection of any form of electrical equipment or similar heat-sensitive entities which are utilized in thermally-hostile environments. Furthermore, it should be noted that the uses of the present invention are not restricted to the protection of electrical devices alone.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A self-contained apparatus for maintaining electronic equipment and the like at low temperatures in hot ambient environments, said apparatus comprising:

an outer housing;

an inner dewar disposed within said outer housing so as to be thermally insulated therefrom;

an inner housing for containing said equipment, said inner housing being disposed within said inner dewar;

a quantity of coolant absorbent material disposed within said inner dewar;

a cooling medium disposed within said housing either wholly or partially in its liquid phase which is contained within said inner dewar and about said inner housing, or wholly or partially absorbed by said coolant absorbent material, said absorbent material being capable of absorption of the vapor phase of said coolant medium, said vapor phase being in fluid communication with said absorbent material and with said liquid phase; and a pressure activated, thermostatically control valve for interrupting fluid communication between said vapor phase and said absorbent material in response to thermal conditions in said inner housing, whereby thermal conditions about said inner housing can be controlled through the control vaporization of the liquid phase of said coolant medium together with its absorption by said absorption material within said outer housing.

2. The apparatus of claim 1 in which said coolant medium comprises water.

3. The apparatus of claim 1 in which said coolant absorbent comprises materials selected from the group consisting of calcium oxide, sodium oxide, phosphorous oxide and Zeolite.

4. The apparatus of claim 1 in which said inner dewar is disposed within said outer housing so as to define a volume between said inner dewar and said outer housing, said volume being evacuable, said evacuable volume being fluidically isolated from the volume occupied within said outer housing by said vapor phase.

5. The apparatus of claim 1 further comprising a closable evacuation conduit in fluid communication with the vapor phase within the interior of said outer housing.

6. The apparatus of claim 1 in which said outer housing has a removable end portion.

7. The apparatus of claim 1 in which thermal insulation is disposed between said absorbent material and said liquid phase.

8. The apparatus of claim 1 further including a conduit in fluid communication with the interior of said inner housing, whereby means are provided for electrical conductors to be provided to the interior of said inner housing.

9. The apparatus of claim 1 in which said outer housing is adapted for attachment to a bore hole wire line instrumentation capsule.

10. The apparatus of claim 1 further including a low emissivity lining on that portion of the outer housing adjacent to said inner dewar.

11. The apparatus of claim 1 in which said coolant absorbent is disposed in a plurality of canisters.

12. The apparatus of claim 1 in which said absorbent is disposed in canisters in thermal contact with the walls of said outer housing.

13. The apparatus of claim 1 in which said absorbent is disposed in at least one canister in which there is provided screen means disposed to enhance contact between said absorbent and said vapor phase.

14. The apparatus of claim 1 in which said thermostatically controlled valve comprises:

an expandable, liquid filled chamber in thermal contact with said inner housing, said liquid in said chamber being capable of vaporization so as to cause expansion of said chamber; and means disposed adjacent to said chamber operable to open the said valve upon expansion of said chamber.

* * * * *